US006005473A

United States Patent [19]

Ishihara

[11] Patent Number: 6,005,473

[45] **Date of Patent: *Dec. 21, 1999**

[54] ROTARY OPERATION TYPE VARIABLE RESISTOR

[75] Inventor: Kanji Ishihara, Miyagi-ken, Japan

[73] Assignee: Alps Electric Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/585,580

[22] Filed: Jan. 16, 1996

[30] Foreign Application Priority Data

| | | | |
|---|---|---|---|
| Jan. 20, 1995 | [JP] | Japan | 7-007299 |
| Feb. 13, 1995 | [JP] | Japan | 7-024229 |
| Feb. 27, 1995 | [JP] | Japan | 7-038484 |

[51] Int. Cl.[6] ..... H01C 10/32

[52] U.S. Cl. ..... 338/167; 338/163; 338/170

[58] Field of Search ..... 338/162, 163, 338/164, 167, 169, 170, 172, 173, 174

[56] References Cited

U.S. PATENT DOCUMENTS

| | | | |
|---|---|---|---|
| 3,629,780 | 12/1971 | Burcham et al. | 338/198 |
| 3,683,308 | 8/1972 | Hamill | 338/162 |
| 3,905,097 | 9/1975 | Beetle | 29/620 |
| 3,970,986 | 7/1976 | Seyler et al. | 338/171 |
| 4,523,175 | 6/1985 | Sakurai | 338/134 |
| 4,701,740 | 10/1987 | Reuss et al. | 338/164 |
| 4,894,638 | 1/1990 | Flierl et al. | 338/162 |
| 5,039,975 | 8/1991 | Ishihara | 338/312 |
| 5,053,742 | 10/1991 | Masuda | 338/162 |
| 5,144,277 | 9/1992 | Ishihara et al. . | |

FOREIGN PATENT DOCUMENTS

| | | | |
|---|---|---|---|
| 524523 | 1/1956 | Canada | 338/172 |
| 0410146 | 1/1991 | European Pat. Off. | 338/160 |
| 1297417 | 5/1962 | France | 338/162 |
| 2-264403A | 1/1991 | Japan | 338/160 |
| 6-37707 | 5/1994 | Japan . | |

*Primary Examiner*—Michael L. Gellner
*Assistant Examiner*—Karl Easthom
*Attorney, Agent, or Firm*—Brinks Hofer Gilson & Lione

[57] ABSTRACT

A rotary operation type variable resistor including a resistor base and a holder, on which a sliding-element supporting member is rotatably retained, are placed in a case provided with only one opening for component insertion. An operating lever is fixedly connected to a shaft portion of the sliding-element supporting member using a speed nut. A resistor pattern is formed by printing on the resistor base in a positional relationship determined by positioning reference portions formed on the resistor base. Positioning reference portions are also formed on the holder, and positioning portions are formed in the case. A resilient-contact member for bringing the positioning reference portions of each of the resistor base and the holder into contact with the positioning portions of the case is also provided on the case. A lower bearing made of stainless steel and formed by pressing so as to have a cylindrical portion and a flange formed at one end of the cylindrical portion is integrally combined with the holder by insert molding, while an upper bearing is press-fitted to the holder, thereby forming a bearing unit for receiving the shaft portion of the sliding-element supporting member.

12 Claims, 7 Drawing Sheets

ROTARY OPERATION TYPE VARIABLE RESISTOR

BACKGROUND OF THE INVENTION

1. Field of the Invention

The present invention relates to a rotary operation type variable resistor suitable for use in an electronic apparatus which is used in a dusty and moist environment and which, therefore, needs high tightness, e.g., a throttle position sensor provided in a motor vehicle to perform a throttle control by adjusting the opening of a fuel injection valve according to the amount of depression of an accelerator pedal.

2. Description of the Related Art

FIG. 11 is a cross-sectional view of an example of a conventional rotary operation type variable resistor of this kind, which has been proposed by the applicant of the present invention. As shown in FIG. 11, the rotary operation type variable resistor has a case 20 which forms an outer shell of a throttle position sensor, and which is open at its upper and lower ends. A partition wall 21 is formed inside the case 20, and a bearing 22 is inserted in the partition wall 21. A sliding-element supporting member 23 and a resistor base 24 are successively inserted into the case 20 through the lower opening of the case 20. A shaft portion 23*a* of the sliding-element supporting member 23 is passed through the bearing 22 to reach the upper opening of the case 20. Sliding elements 25 are attached to a lower end portion of the sliding-element supporting member 23. The sliding elements 25 resiliently contact a resistor pattern 26 formed in a printing manner on a surface of the resistor base 24. The resistor base 24 is fixed inside the case 20 by a stepped portion formed in an inner wall of the case 20 and by a lid member 27 attached to the lower opening end of the case 20. On the other hand, at the upper opening end of the case 20, an operating lever 28 is fitted around the shaft portion 23*a* of the sliding-element supporting member 23 projecting out of the bearing 22. The end of the shaft portion 23*a* is caulked from the state indicated by the double-dot-dash line in FIG. 11 to the state indicated by the solid line in FIG. 11, thereby fixing the operating lever 28 on the sliding-element supporting member 23.

When the case 20 of the rotary operation type variable resistor thus constructed is mounted on a frame of a motor vehicle, the operating lever 28 is connected to an actuator of a throttle valve. As the operating lever 28 is rotated according to a throttle position or the like, the sliding-element supporting member 23 connected to the operating lever 28 is rotated together with the operating lever 28. The sliding elements 25 that resiliently contact the resistor pattern 26 on the resistor base 24 are thereby caused to slide on the resistor pattern 26, thereby changing the resistance of the variable resistor. From the resistance value, the throttle position or the like can be detected. The attachment structure of the case 20 is as described below. The throttle valve and other parts are accommodated in the frame having a hole. The case 20 is partially inserted into the hole so that the operating lever 28 faces the throttle valve. Thereafter, the case 20 is fixed on the frame by using screws or other means. At this time, the lid member 27 attached to the case 20 faces outwardly opposite from the frame, so that it can be exposed to dust, muddy water and the like. To prevent such extraneous materials from entering the case 20, joint cavities formed by portions of the lid member 27 and the case 20, and the like are filled with a sealing adhesive 29.

A known product designed as the above-described rotary operation type variable resistor has a hole formed in the resistor base 24 at a virtual center of the same corresponding to the center of rotation of the shaft portion 23*a*, and has the resistor pattern 26 formed by printing with this hole used as a reference portion. Also, a plurality of projections are formed on the opening peripheral end of the case 20. Notches formed in the peripheral end of the resistor base 24 are positioned on the projections. The size of portions of the opening peripheral end other than the projections is selected so that the peripheral end of the resistor base 24 can be press-fitted into the opening. This variable resistor is assembled as described below. The sliding-element supporting member 23 on which the sliding elements 25 are fixed is inserted and rotatably retained in the bearing 22 that has been inserted into the case 20. The operating lever 28 is then attached to the shaft portion 23*a*. Thereafter, the resistor base 24 is positioned on the case 20, and its peripheral end is press-fitted into the opening. Further, the lid 27 is placed so as to cover the resistor base 24, and the gap between the lid 27 and the case 20 is thereafter filled with adhesive 29 to fix the lid 27 in the opening of the case 20.

The bearing 22 of this kind of conventional rotary operation type variable resistor as a product is ordinarily formed in such a manner that a cylindrical bearing piece made of brass is integrally formed by an insert molding technique in the bearing hole formed in the case 20, and the inner circumferential surface of the cylindrical bearing piece is machined with certain accuracy necessary for the desired bearing performance. The shaft portion 23*a* of the sliding-element supporting member 23 is fitted in the bearing thus formed.

The above-described conventional rotary operation type variable resistor requires, in the process of assembling the parts in the case 20, steps of inserting the sliding-element supporting member 23 into the bearing 22 through one opening of the case 20, fitting the operating lever 28 around the shaft portion 23*a* at the other opening, caulking the corresponding end of the shaft portion 23*a* to fix the operating lever 28 on the sliding-element supporting member 23, and successively inserting the resistor base 24 and the lid 27 in the opening through which the sliding-element supporting member 23 has been inserted. That is, it is necessary for the parts to be assembled by being passed through or fitted in the two openings of the case 20, and it is also necessary to insert a jig into the opening of the case 20 at the member 23 insertion side for the purpose of receiving a caulking force when the end of the shaft portion 23*a* is caulked. Thus, troublesome assembly operations are required. Moreover, it is necessary to tightly seal the opening end side of the case 20 to which the lid 27 for covering the resistor base 24 is attached. There is, therefore, a need to fill the joint cavities formed by the lid member 27 and the case 20 and the like with adhesive 29, resulting in a further reduction in the facility of the assembly work.

In the above-described conventional rotary operation type variable resistor, the resistor base is positioned only before being pressed fitted to the opening with its peripheral end deformed. Therefore, a misalignment occurs easily between the resistor base and the case due to variation in the amount of deformation when the resistor base is attached to the case. For this reason, it is difficult to accurately attach the resistor base to the case. On the other hand, it is necessary to set a certain amount of play between the positioning reference center hole and a printing mask positioning pin (positioning member), which is large enough to enable the center hole and the positioning pin to engage with and disengage from each other. Therefore, a center misalignment (printing misalignment) of the printed resistor pattern can occur easily and it is difficult to maintain the desired accuracy of the position of the resistor pattern on the resistor base. Thus, the accuracy of each of positioning between the resistor base and the case and positioning between the resistor base and the resistor pattern is considerably reduced. Consequently, it is difficult to maintain the desired accuracy of the positions of the sliding elements and the resistor pattern supported on the case, so that the linearity of the resulting resistance changing characteristic is low.

In the above-described arrangement, two reference portions or members, i.e., the one for positioning when the resistor pattern is printed and the other for positioning when the resistor base is mounted in the case, are used. In such a case, if an error occurs in the mounted position of the resistor base in the case due to a variation in size as described above, the amount of error cannot be grasped accurately. As a result, the size control at the time of manufacturing is complicated.

Further, in manufacturing the above-described conventional rotary operation type variable resistor, there is a need to newly prepare molds for forming the case according to varieties of the attachment portion, and a step of assembling various parts in the case is required at the time of assembly. Accordingly, it is necessary to change jigs suitable for assembly steps each time the case is changed, so that the assembly process is complicated. To solve such a problem, a construction may be adopted in which only the attachment portion is formed separately from the case. Then, a misalignment occurs between the centers of rotation of the operating lever and the throttle position if the attachment portion is not accurately attached to the case. In such a situation, it is difficult to achieve the desired linearity of the change the resistance value of the variable resistor with respect to the change in the throttle position.

Moreover, in the above-described conventional rotary operation type variable resistor, a cylindrical metal bearing requiring machining on its inner circumferential surface is adopted for the bearing structure for axially supporting the sliding-element supporting member. Troublesome machining steps are therefore required, so that the productivity is low. The manufacturing cost is increased thereby.

SUMMARY OF THE INVENTION

In view of the above-described problems, an object of the present invention is to provide a rotary operation type variable resistor which is free from the above-described problems of the conventional art and which is designed to improve the facility with which component parts are assembled.

Another object of the present invention is to provide a rotary operation type variable resistor free from a risk of the sliding elements being plastically deformed at the time of assembly.

Still another object of the present invention is to provide a rotary operation type variable resistor which is improved in the facility of assembly work, which is designed so that the operating lever can easily positioned with the desired accuracy when the body of the variable resistor is mounted on a frame of a motor vehicle or the like, and which has an improved resistance changing characteristic.

A further object of the present invention is to provide a rotary operation type variable resistor which is designed according to varieties of the attachment portion so as to simplify the assembly process without any deterioration in performance.

Still a further object of the present invention is to provide a rotary operation type variable resistor in which the bearing structure for axially supporting the sliding-element supporting member can be formed easily, and which can be manufactured at a lower cost.

To achieve these objects, according to one aspect of the present invention, there is provided a rotary operation type variable resistor comprising a case having an opening in one end surface and having an attachment portion and a closed bottom, a resistor base provided on an inner bottom portion of the case and having a resistor pattern formed on its surface, a sliding-element supporting member having a sliding element supported thereon, the sliding element being maintained in sliding contact with the resistor pattern, a holder for rotatably supporting the sliding-element supporting member, the holder being retained in the case, an operating lever fixed integrally on an outer end portion of the sliding-element supporting member to enable the position of the sliding-element supporting member to be changed, a shaft portion formed on the sliding-element supporting member and having a stepped portion, the shaft portion projecting on the opening end side of the case by extending through the holder, and retaining means for retaining the operating lever in such a manner that the operating lever is pinched between the retaining means and the stepped portion of the shaft portion.

Preferably, in the above-described arrangement, a resilient member is interposed between the operating lever and the holder, and a receiving portion projecting from an end surface of the sliding-element supporting member on the resistor base side is formed so as to able to abut against the resistor base or the case when the sliding element is pushed to move to a predetermined extent toward the resistor base. In such a case, the receiving portion of the sliding-element supporting member is formed at the center of rotation of the sliding-element supporting member.

According to another aspect of the present invention, there is provided a rotary operation type variable resistor comprising a case having an opening in one end surface and having an attachment portion and a closed bottom, a resistor base provided on an inner bottom portion of the case and having a resistor pattern formed on its surface, a sliding-element supporting member for supporting a sliding element which contacts the resistor pattern, a holder for rotatably supporting the sliding-element supporting member, the holder being retained in the case, an operating lever fixed integrally on an outer end portion of the sliding-element supporting member to enable the position of the sliding-element supporting member to be changed, positioning reference portions formed on the holder, positioning portions formed on the case and capable of abutting against the positioning reference portions of the holder, and a resilient element provided on the case to resiliently urge the holder so that the positioning reference portions of the holder abut against the positioning portions of the case.

Preferably, in the above-described arrangement, the positioning portions of the case are formed along vertical planes, positioning reference portions capable of abutting against the positioning portions of the case are provided on the resistor base, and a resilient element for resiliently urging the resistor base so that the positioning reference portions of the resistor base abut against the positioning portions of the case is provided on the case. The above-described arrangement may also be such that the positioning portions provided on the case are formed along vertical planes intersecting each other, and the resilient elements provided on the case are placed so as to face in the direction toward the point of intersection of the vertical planes. Preferably, the resistor pattern is formed based on the positioning reference portions of the resistor base.

Also, preferably, the resistor base is fixed on the holder. Further, the arrangement may be such that positioning reference portions are provided on a peripheral end of the resistor base, and the resistor pattern is formed based on the positioning reference portions of the resistor base.

According to still another aspect of the present invention, there is provided a rotary operation type variable resistor comprising a holder having a shaft hole, a pair of metal bearing members each formed by pressing into a shape having a hollow cylindrical portion and a flange portion at one end of the cylindrical portion, the metal bearing members being disposed at opposite opening ends of the shaft hole of the holder, a resistor base having a resistor pattern formed on its surface, and a sliding-element supporting member having a sliding element supported thereon, the sliding element being maintained in sliding contact with the resistor pattern, the sliding-element supporting member being supported by the bearing members axially rotatably. In this arrangement, at least one of the pair of metal bearing members may be integrally combined with the holder by insert molding in such a manner that the metal bearing member is inserted in a mold for forming the holder. Also, at least one of the pair of metal bearing members provided on the shaft hole is press-fitted into the corresponding opening end of the shaft hole.

According to the present invention, the holder axially supporting the resistor base and the sliding-element supporting member is fixed in the case having a closed bottom by being inserted into the case through one opening side and, thereafter, the operating lever may be fitted around the shaft portion of the sliding-element supporting member projecting from the holder and then fixed by a retaining means. Thus, the components parts can be assembled in the case by being placed one on another through one open side of the case, thereby improving the facility of the assembly work. When the rotary operation type variable resistor is attached to a frame of a motor vehicle, the external bottom surface of the case faces outward opposite from the frame. Therefore, there is no need for sealing using a lid and any other separate member such as those required by the conventional art.

Also, the arrangement is such that, when the operating lever is fixed on the sliding-element supporting member with a pressing force after the holder in the state of being mounted in the case before the operating lever is attached has been fixed in the case without interference through the operating lever, and when the sliding-element supporting member is pushed in to a predetermined extent toward the resistor case by the pressing force, the receiving portion of the sliding-element supporting member is brought into abutment against the resistor base or the case to prevent the bottom surface of the sliding-element supporting member from being excessively close to the resistor base, thereby reliably preventing plastic deformation of the sliding element. When the sliding-element supporting member is pushed in to move toward the resistor base in this manner, the above-mentioned resilient member is compressed. When the application of the pressing force is stopped by the completion of connection between the operating lever and the sliding-element supporting member, the operating lever and the sliding-element supporting member are moved upward and away from the resistor base by the restoring force of the elastic member. The receiving portion is thereby moved apart from the member that has been in abutment against the receiving portion.

According to the present invention, when the case is attached to a frame of a motor vehicle, the external bottom surface of the case faces outward opposite from the frame. Therefore, there is no need for sealing using a lid and any other separate member such as those required by the conventional art. One resilience element provided on the case is used to resiliently urge the holder toward the positioning portions of the case to achieve an increase in the accuracy with which the holder is mounted in the case, so that the variable resistor attachment portion provided on the case and the operating lever axially supported on the holder can be relatively positioned more easily. Also, the desired positioning accuracy of the operating lever when the body of the variable resistor is attached to the frame of the motor vehicle can be achieved more easily.

The resistor base may also be urged by the resilient element provided on the case so that the positioning reference portions of the resistor base abut against the positioning portions of the case, thereby ensuring that a misalignment cannot occur easily between the resistor base and the holder. Further, the resistor pattern may also be formed by printing based on the positioning reference portions of the resistor base to reduce a misalignment between the resistor base and the resistor pattern. Accordingly, the resistor base, the resistor pattern and the holder have one structural basis. Therefore, if only size control of each component is performed, there is no need to perform size control of combinations of the components, thus facilitating size control at the manufacturing stage.

If the case having the attachment portion and the holder on which the resistor base and the siding-element supporting member are fixed are provided separately from each other, the case can easily be adapted to varieties of the attachment portion. Also, a unit formed by the holder and the other components on the holder can be formed to reduce changes of jigs and to simplify the assembly process. Moreover, since the holder is resiliently urged by the resilient element of the case to bring the positioning reference portions of the holder into abutment against the positioning portions of the case, a misalignment cannot occur easily between the case and the holder.

Further, the short metal bearings each formed by pressing so as to have a cylindrical portion and a flange portion formed at one end of the cylindrical portion has an inner circumferential surface with reduced surface irregularities and does not need machining. Therefore, if these metal bearings are respectively disposed at the opposite opening ends of the shaft hole of the holder, a bearing structure for axially supporting the sliding-element supporting member can easily be formed. If a stainless steel plate, for example, is used as the material of the metal bearings, a sufficiently high mechanical strength can be obtained because work hardening occurs in the material at the time of pressing.

These and other objects, features and advantages of the present invention will become apparent from the following detailed description of embodiments of the invention.

DESCRIPTION OF THE PREFERRED EMBODIMENTS

Figure 1:
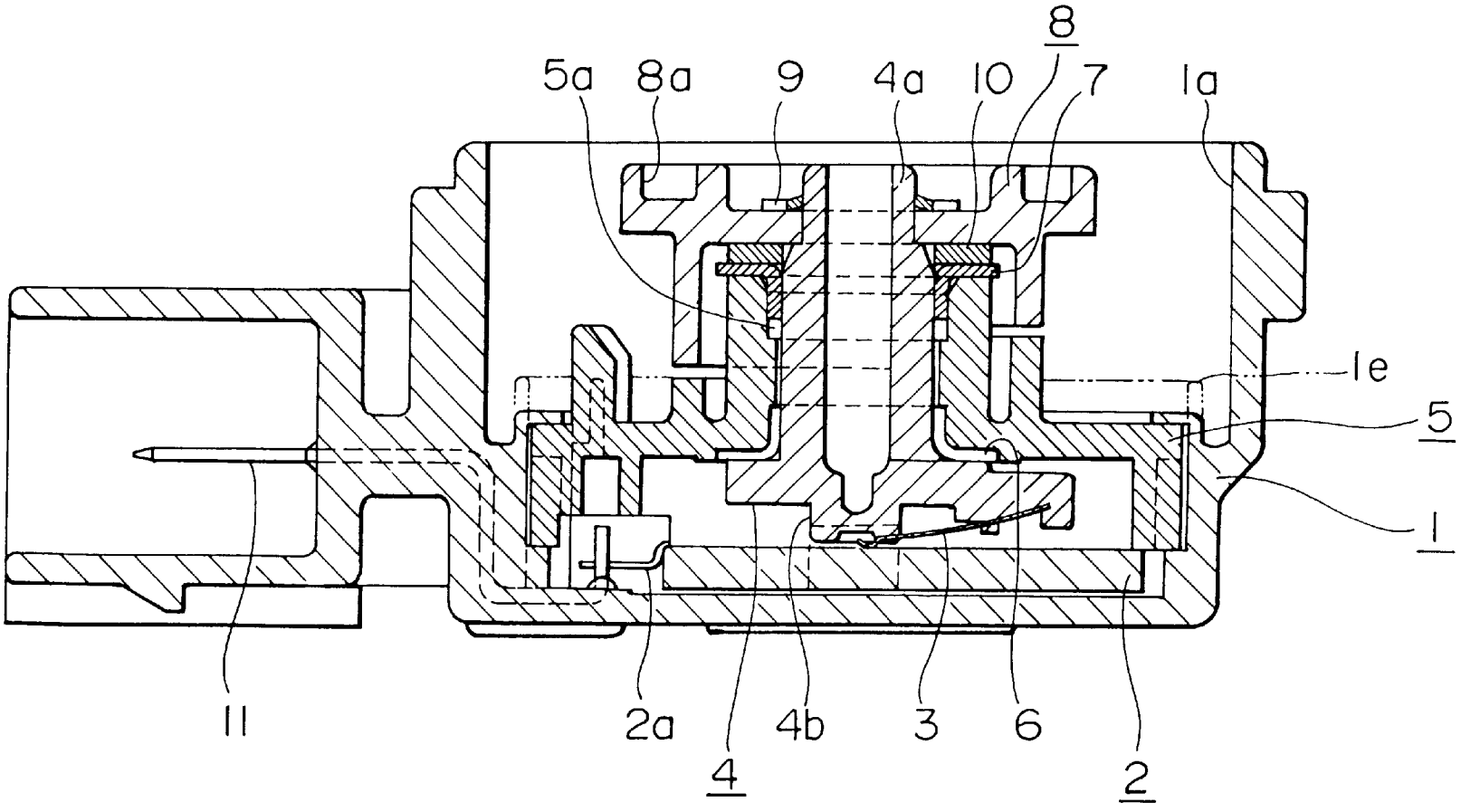
FIG. 1 is a cross-sectional view of the entire configuration of a first embodiment of the present invention.

Preferred embodiments of the present invention will be described below with reference to the accompanying drawings.

A rotary operation type variable resistor which represents a first embodiment of the present invention will be described with reference to FIGS. 1 to 5. This variable resistor is a product used as a throttle position sensor in a motor vehicle.

As illustrated, a case 1 forms an outer shell of this variable resistor and has an attachment portion 1*f*. A resistor pattern (not shown) having a circular arc configuration is formed by printing on a resistor base 2. A sliding element 3 is formed of a resilient thin metal plate made of phosphor bronze, and resiliently contacts the resistor pattern. A sliding-element supporting member 4 supports the sliding element 3 at its bottom side, and has a stepped shaft portion 4*a* projecting at the opposite side. A holder 5 axially supports the sliding-element supporting member 4 with the shaft portion 4*a* inserted in a shaft hole 5*a*. Lower and upper bearings 6 and 7 made of stainless steel are disposed at opposite opening ends of the shaft hole 5*a*. An operating lever 8 is connected to the sliding-element supporting member 4 and is rotatable relative to the holder 5. The operating lever 8 is located inside an opening 1*a* of the case 1 close to a plane defining the outer end of the opening 1*a*. A speed nut (retaining portion) 9 is provided to fix the operating lever 8 on the shaft portion 4*a* of the sliding-element supporting member 4. A wave washer (resilient member) 10 is interposed between the operating lever 8 and the holder 5. Connection terminals 11 are integrally combined with the case 1 by an insert forming technique. Each of the resistor base 2 and the holder 5 is positioned and fixed in the case 1. The connection terminals 11 are connected to terminal members 2*a* provided on the resistor base 2. The rotary operation type resistor thus constructed is attached to a frame of a motor vehicle with an actuator (not shown) brought into engagement with a recess 8*a* of the operating lever 8. When the actuator causes the operating lever 8 to rotate, the sliding-element supporting member 4 and the sliding element 3 rotate integrally with the operating lever 8. The sliding element 3 slides on the resistor pattern on the resistor base 2 by this rotation so that a resistance value of the variable resistor is changed. From the resistance value, a throttle position can be detected.

In this embodiment, the above-mentioned resistor pattern in the form of a circular arc is formed by using two reference planes A and B (see FIG. 3) for positioning, which are defined by projections 2*b* and a flat portion 2*c* (second position reference positions) forming peripheral end portions of the resistor base 2 so as to be perpendicular to each other. The holder 5 also has two types of projections (position reference portions) 5*b* and 5*c* which define two reference planes C and D perpendicular to each other (see FIG. 5). Further, as inner portions of the case 1, two types of positioning portions 1*b* and 1*c* for defining two positioning reference planes E and F (see FIG. 2) are provided. In the case 1 is also provided a resilient part 1*d* to resiliently urge the resistor base 2 so that projections 2*b* and the flat portion 2*c* of the resistor base 2 abut against the positioning portions 1*b* and 1*c*, respectively, and to resiliently urge the holder 5 so that the projections 5*b* and 5*c* of the holder 5 abut against the positioning portions 1*b* and 1*c*, respectively. The resilient part 1*d* has a portion $\mathbf{1}d_1$ smaller in height and another portion $\mathbf{1}d_2$ larger in height. At the time of assembly in the case 1, the resistor base 2 and the holder 5 are positioned by the positioning portions 1*b* and 1*c* and the portions $\mathbf{1}d_1$ and $\mathbf{1}d_2$ of the resilient part 1*d* so that both the reference planes A and C coincide with the positioning plane E while both the reference planes B and D coincide with the positioning plane F.

The thus-constructed rotary operation type variable resistor is assembled as described below. First, when the resistor base 2 is inserted into the case 1, the lower portion $\mathbf{1}d_1$ of the resilient part 1*d* resiliently urges a portion of the resistor base 2 indicated by α in FIG. 3 so that the reference plane A of the resistor base 2 coincides with the positioning plane E of the case 1 while the reference plane B of the resistor base 2 coincides with the positioning plane F of the case 1. Also, the resistor base 2 is inserted between caulking portions indicated by β in FIG. 2. These caulking portions β are caulked to fix the resistor base 2 on the case 1. At this time, the terminal members 2*a* on the resistor base 2 are press-fitted to the connection terminals 11 on the case 1 to establish a connection therebetween. Each terminal member 2*a* has opposite side portions $\mathbf{2}a_1$ which function mainly to bite the connection terminal 11 and a portion $\mathbf{2}a_2$ which resiliently contacts the connection terminal 11.

Next, the sliding-element supporting member 4 on which the sliding element 3 is fixed is inserted into the two bearings 6 and 7 on the holder 5. Thereafter, the sliding-element supporting member 4 and the holder 5 are inserted into the case 1. At this time, the higher portion $\mathbf{1}d_2$ of the resilient part 1*d* resiliently urges a portion of the holder 5 indicated by γ in FIG. 5 so that the reference plane C of the holder 5 coincides with the positioning plane E of the case 1 while the reference plane D of the holder 5 (defined by projections 5*c*) coincides with the positioning plane F of the case 1. The top end of the higher portion $\mathbf{1}d_2$ of the resilient part 1*d* is formed into a hook-like shape such that the holder 5 inserted into the case 1 is retained on the case 1 by this hook-like portion in a snap fashion.

Figure 2:
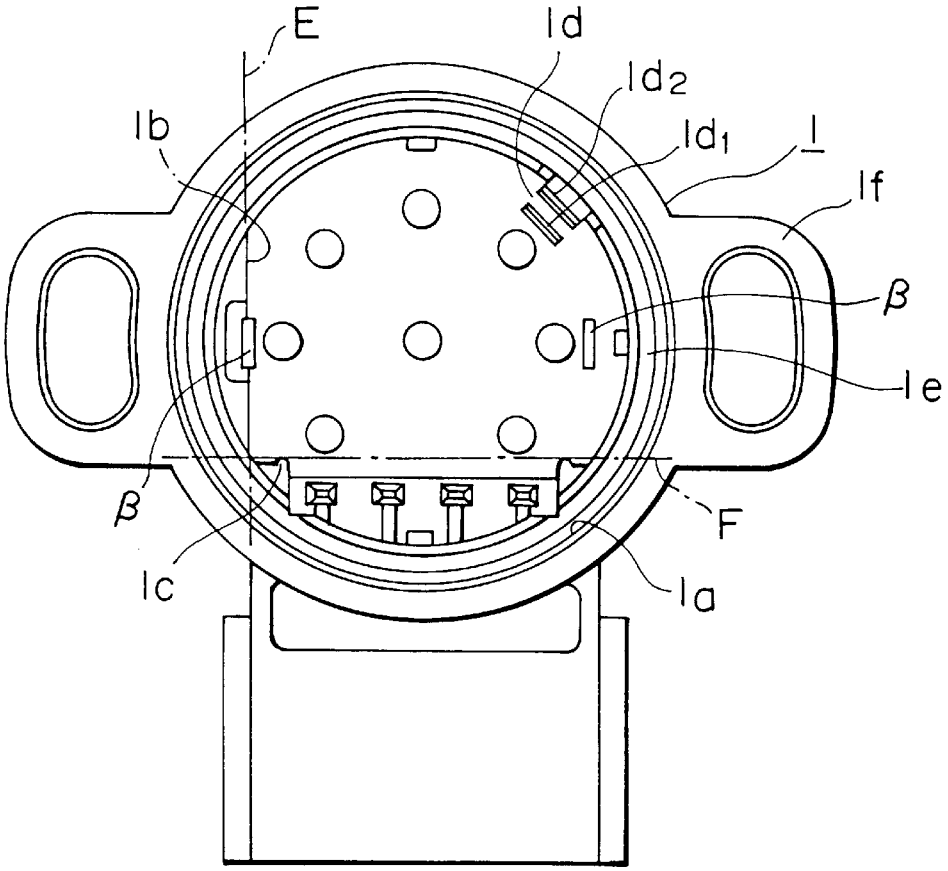
FIG. 2 is a plan view of the first embodiment showing an inner bottom surface of the case.
Figure 3:
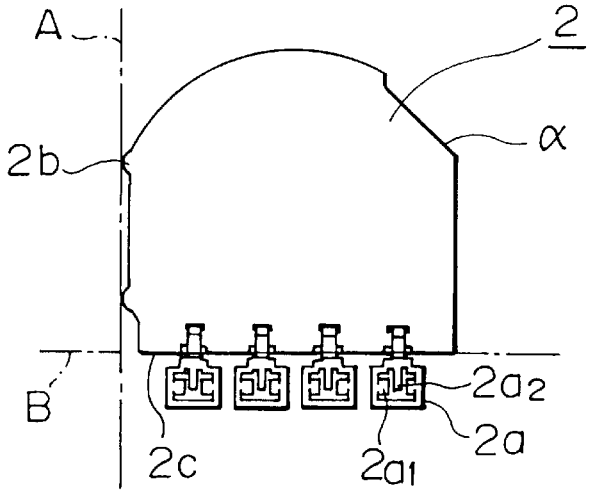
FIG. 3 is a plan view of the resistor base of the first embodiment.

Thereafter, a wall portion 1*e* shown in FIGS. 1 and 2 is heat-caulked to fix the holder 5 on the case 1. Finally, the wave washer 10, the operating lever 8 and the speed nut 9 are successively assembled on the shaft portion 4*a* of the sliding-element supporting member 4, and the operating lever 8 is fixed on the shaft portion 4*a* of the sliding-element supporting member 4 by being pinched between the stepped portion of the shaft portion 4*a* and the speed nut 9, thus completing the assembly of the rotary operation type variable resistor. (The operating lever 8 may be fixed by heat-caulking the shaft portion 4*a* instead of using the speed nut 9.) After the completion of the assembly, a performance test is made.

In this embodiment, the resistor pattern is formed by printing with portions of the peripheral end of the resistor base 2 used as a positioning reference. The need for a play between positioning members, such as that in the case of using a center hole for printing positioning reference, is thereby eliminated, so that a center misalignment (printing misalignment) of the resistor pattern can be avoided. When the resistor base 2 and the holder 5 are assembled in the case 1, they are positioned so that the reference planes A and B coincide with the reference planes C and D, respectively. In order to automatically align the center positions of the resistor base 2 and the sliding-element supporting member 4 by this positioning, the clearance between the shaft hole 5*a* of the holder 5 and the sliding-element supporting member 4 is set to, for example, 0.01 to 0.02 mm. Therefore, the probability of the center of the circular-arc configuration of the resistor pattern free from a center misalignment being misaligned from the center of rotation of the sliding-element supporting member 3 is low, so that the sliding element 3 can easily be positioned with respect to the resistor pattern with the desired accuracy, thereby improving the linearity and stability of the resistance value changing characteristic. If the same positioning reference is used both for printing the resistor pattern and for setting the resistor base 2 in the case 1 as described above, it is possible to accurately grasp an amount of error in positioning the resistor base 2 mounted in the case 1 due to a variation in size. The size control at the manufacturing stage is thereby facilitated.

Figure 4:
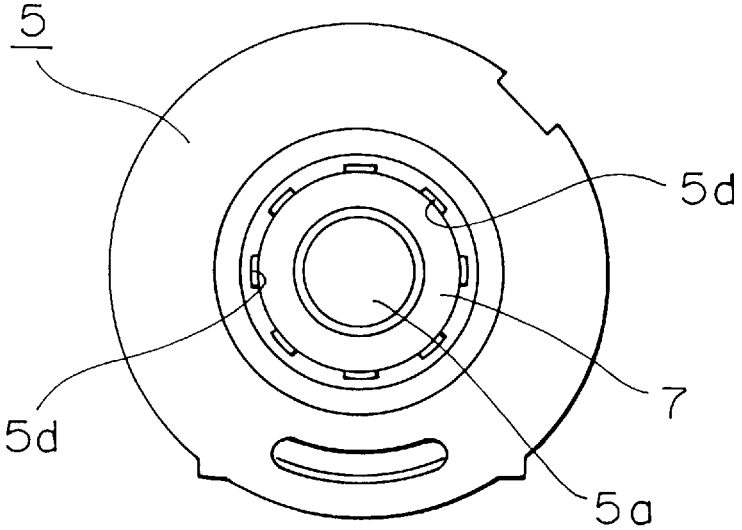
FIG. 4 is a plan view of a holder of the first embodiment.

In this embodiment, each of the lower bearing 6 and the upper bearing 7, disposed at the opposite opening ends of the shaft hole 5*a* of the holder 5, is a short stainless steel bearing formed by pressing so as to have a cylindrical shape with a flange formed at one end, and the inner circumferential surface of the cylindrical portion through which the shaft portion 4*a* of the sliding-element supporting member 4 is passed is finished with reduced surface irregularities by a press. Therefore, there is no need to specially machine the inner circumferential surface of the cylindrical portion. The lower bearing 6 is formed integrally with the holder 5 by an insert molding technique, i.e., by being inserted into a mold for forming the holder 5. On the other hand, the upper bearing 7 fixed on the holder 5 with its cylindrical portion press-fitted into the upper opening end of the shaft hole 5*a* of the holder 5. If only the lower and upper bearings 6 and 7 are provided on the holder 5 in this manner, a bearing structure for axially supporting the sliding-element supporting member 4 can easily be formed. Holes 5*d* shown in FIG. 4 are formed by the insertion of pressing pins for pressing the lower bearing 6 at a predetermined position in the mold at the time of insert molding. By pressing, work hardening occurs in the stainless plate for forming the bearings 6 and 7, thereby ensuring a sufficiently large mechanical strength of the bearings 6 and 7.

Further, in this embodiment, a receiving portion 4*b* is formed as a projection on the bottom surface of the sliding-element supporting member 4 (facing the resistor base 2) at the center of rotation thereof. The receiving portion 4*b* abuts against the resistor base 2 to prevent plastic deformation of the sliding element 3 when the sliding-element supporting member 4 is pushed in to move toward the resistor base 2 to a predetermined extent. Also, the wave washer 10 is interposed between the operating lever 8 and the holder 5. Therefore, the facility with which the rotary operation type variable resistor is assembled and the reliability of the variable resistor are improved even if the variable resistor is designed so as to be reduced in size. That is, in this embodiment, an assembly process is adopted in which the holder 5 in the state of being mounted in the case 1 before the operating lever 8 is attached is fixed in the case 1 by heat-caulking or other means without interference through the operating lever 8, and in which the operating lever 8 is thereafter fixed on the shaft portion 4*a* of the sliding-element supporting member 4 by using the speed nut 9. When the sliding-element supporting member 4 is pushed in to move toward the resistor base 2 to the predetermined extent by the pressing force caused by fastening the speed nut 9, the receiving portion 4*b* is brought into abutment against a central portion of the resistor base 2 to prevent the bottom surface of the sliding-element supporting member 4 from being brought excessively close to the resistor base 2. As a result, the operations for attaching the holder 5 and the operating lever 8 are easier to perform, and plastic deformation of the sliding element 3 is prevented to avoid a reduction in reliability.

When the sliding-element supporting member 4 is pressed toward the resistor base 2 as described above, the wave washer 10 is compressed. When the operating lever 8 and the sliding-element supporting member 4 are completely connected and when the application of the pressing force caused by fastening the speed nut 9 is stopped, the operating lever 8 and the sliding-element supporting member 4 are moved upward and away from the resistor base 2 by the restoring force of the wave washer 10. The receiving portion 4*b*, that has been in contact with the resistor base 2, is thereby moved apart from the resistor base 2, thereby preventing the receiving portion 4*b* from causing an increase in operating force and abrasion when the manufactured variable resistor is used.

Figure 6:
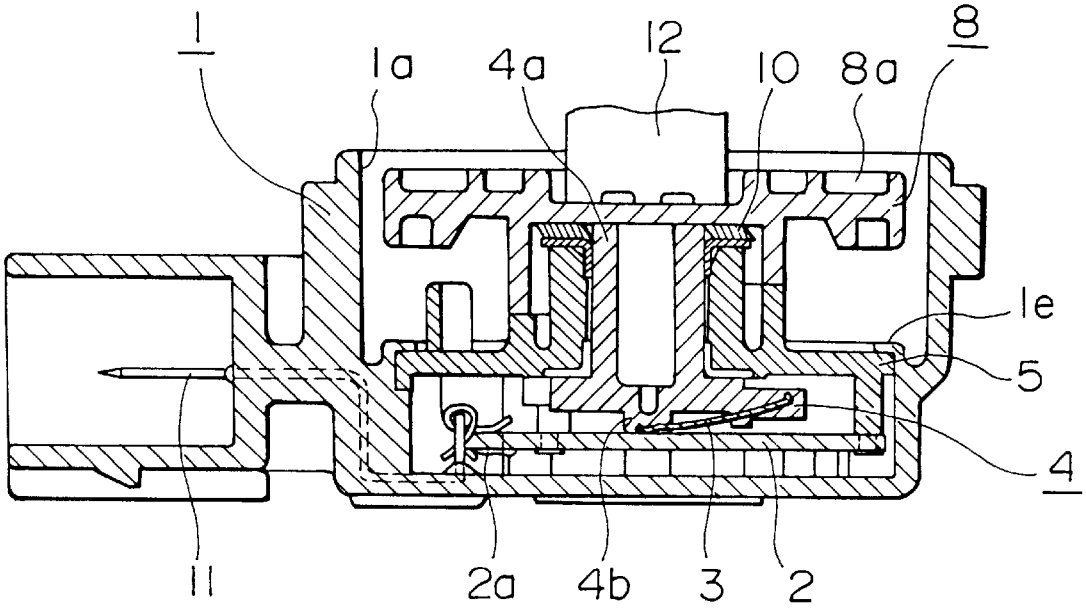
FIG. 6 is a process step diagram showing a state in which the operating lever is connected to the sliding-element supporting member by using a caulking jig.
Figure 7:
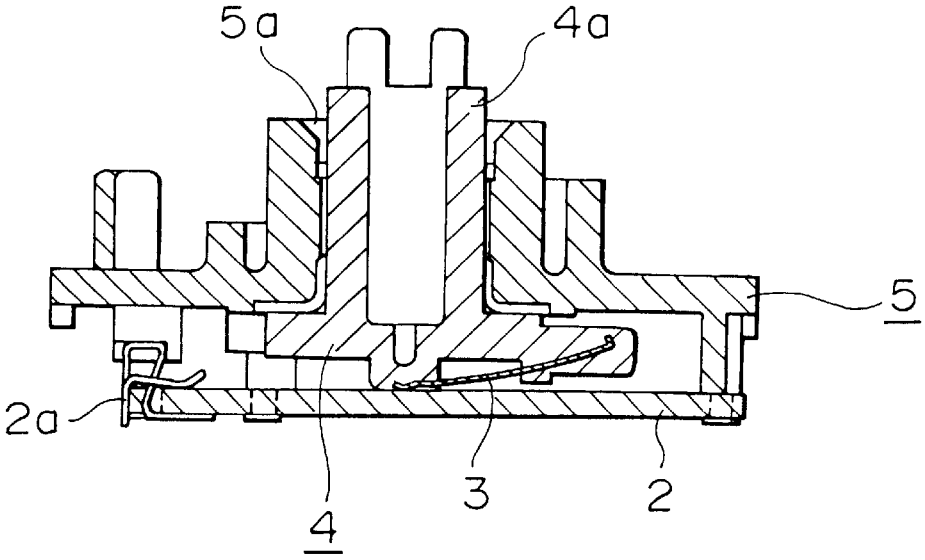
FIG. 7 is a cross-sectional view of essential portions of a second embodiment of the present invention.

A rotary operation type variable resistor which represents a second embodiment of the present invention will next be described with reference to the process step diagram of FIG. 6 and the essential portion cross-sectional view of FIG. 7. In FIG. 6, the same components as those shown in FIG. 1 are indicated by the same reference characters.

In the second embodiment, an assembly process is adopted in which the holder 5 in the state of being mounted in the case 1 before the operating lever 8 is attached is fixed in the case 1 without interference through the operating lever 8, and in which the operating lever 8 is thereafter fixed on the shaft portion 4*a* of the sliding-element supporting member 4. Specifically, in this embodiment, a caulking jig 12 is employed to heat-caulk the shaft portion 4*a*, thereby connecting the operating lever 8 to the sliding-element supporting member 4. In the step for this heat caulking, the sliding-element supporting member 4 is strongly pressed toward the resistor base 2. However, when the sliding-element supporting member 4 is pushed in to a predetermined extent, its receiving portion 4*b* is brought into abutment against a central portion of the resistor base 2 to limit the position of the sliding-element supporting member 4, as shown in FIG. 6. Therefore, there is no risk of the bottom surface of the sliding-element supporting member 4 being brought so close to the resistor base 2 that the sliding element 3 is plastically deformed. When the sliding-element supporting member 4 is pressed toward the resistor base 2 as described above, the wave washer 10 is compressed. When the caulking jig 12 is moved upward as viewed in FIG. 6 after the completion of the operation of connecting the operating lever 8 and the sliding-element supporting member 4, the operating lever 8 and the sliding-element supporting member 4 are moved upward and away from the resistor base 2 by the restoring force of the wave washer 10. The receiving portion 4*b*, that has been in contact with the resistor base 2, is thereby moved apart from the resistor base 2.

In the second embodiment, the resistor base 2 is previously positioned and fixed on the holder 5 so that the resistor base 2 and the holder 5 are combined into a unit before they are assembled in the case forming an outer shell. Portions of the peripheral end of the resistor base 2, which are used as a positioning reference when this unit is formed, are also used as a positioning reference when the resistor pattern is formed by printing on the resistor base 2.

The variable resistor of the second embodiment is assembled as described below. First, the sliding-element supporting member 4 on which the sliding element 3 is fixed is inserted into the two bearings 6 and 7 on the holder 5. The resistor base 2 is then positioned and fixed on the holder 5 so that the resistor base 2 and the holder 5 are combined into a unit, followed by a performance test. Next, this unit is inserted into the case 1 as in the first embodiment. At this time, clip-like terminal members 2*a* fixed on the resistor base 2 are connected to connection terminals 11 on the case 1 simultaneously with the insertion of the unit. The terminal members 2*a* are formed by being bent by about 90 degrees for this connection. Thereafter, the wall portion 1*e* shown in FIG. 6 is heat-caulked to fix the holder 5 on the case 1. Finally, the wave washer 10 and the operating lever 8 are successively fitted around the shaft portion 4*a* of the sliding-element supporting member 4, and the shaft portion 4*a* is heat-caulked with the caulking jig 12 to fix the operating lever 8, thereby completing the assembly of the rotary operation type variable resistor.

As described above, the resistor base 2 on which the resistor pattern is formed by printing is positioned and fixed on the holder 5 on which the sliding-element supporting member 4 is axially supported, whereby the resistor base 2, the holder 5 and other parts are combined into a unit. The unit thus formed is mounted in the case. As a result, a plurality of troublesome assembly operations can be combined into one even if the case is reduced in size so that the openings thereof become smaller, thus improving the facility with which the component parts are assembled. If such a unit is formed, the positional relationship between the resistor base 2 and the sliding-element supporting member 4, that determines the detection accuracy and the operating characteristic of the rotary operation type variable resistor, can be previously determined, so that the holder 5 in the unit can be positioned in the case with comparatively low accuracy. Accordingly, the design shape of the case can be changed easily and the degree of design freedom can be increased. In other words, if the holder 5 axially supporting the sliding-element supporting member 4 and the resistor base 2 are formed into a unit and if this unit is applied in common to cases having various shapes, various rotary operation type variable resistor substantially equivalent in performance but differing in external configuration can easily be manufactured. It is also possible to maintain high reliability and to reduce the manufacturing cost by combining essential components into a common unit.

In the second embodiment, as described above, peripheral end portions of the resistor base 2 are used as a positioning reference for forming the resistor pattern by printing, and the resistor base 2 is fixed on the holder 5 by using the same reference portions. Therefore, the accuracy of positioning the sliding element 3 relative to the resistor pattern can be increased as desired, thus easily achieving an improvement in linearity as well as suitable size control at the manufacturing stage.

Figure 8:
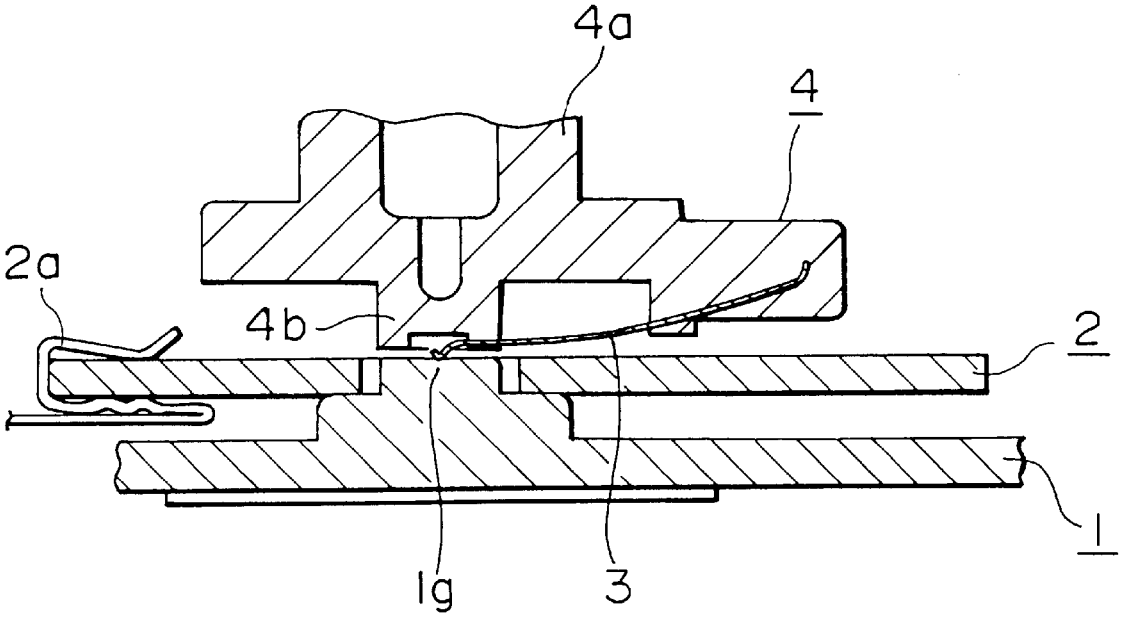
FIG. 8 is a cross-sectional view of essential portions of another embodiment of the present invention.

As each of the first and second embodiments, an arrangement has been described by way of example in which, when the pressing force is applied by the operation of connecting the operating lever 8 to the sliding-element supporting member 4, the receiving portion 4*b* of the sliding-element supporting member 4 is brought into abutment against the resistor base 2 to limit the position of the supporting member 4, whereby the sliding element 3 is prevented from being plastically deformed. However, the arrangement may alternatively be such that, as shown in the essential portion sectional view of FIG. 8, a projection 1*g* projecting in a center hole formed in the resistor base 2 is provided on the inner bottom surface of the case 1, and the receiving portion 4*d* is brought into abutment against the projection 1*g* to limit the position of the sliding-element supporting member 4.

Also, a resilient member other than the wave washer may be interposed between the operating lever 8 and the holder 5 in order to move, after the completion of manufacturing, the receiving portion 4*b* of the sliding-element supporting member 4 apart from the resistor base 2 or the case 1, that has been in contact with the receiving portion 4*b*.

Figure 5:
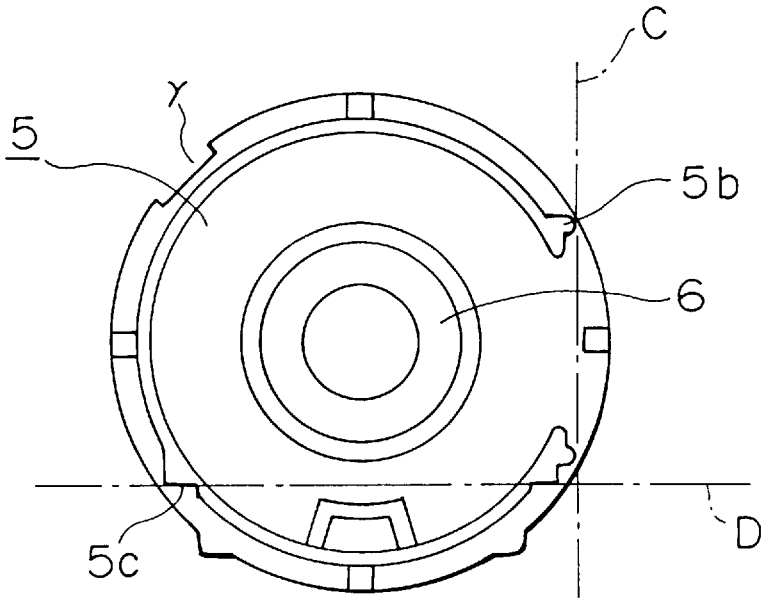
FIG. 5 is a bottom view of the holder of the first embodiment.
Figure 9:
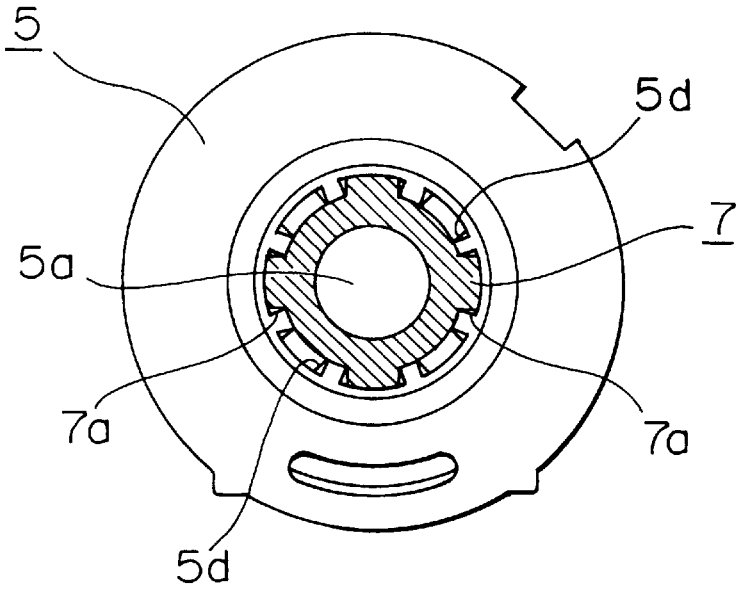
FIG. 9 is a plan view of a holder of a further embodiment of the present invention.
Figure 10:
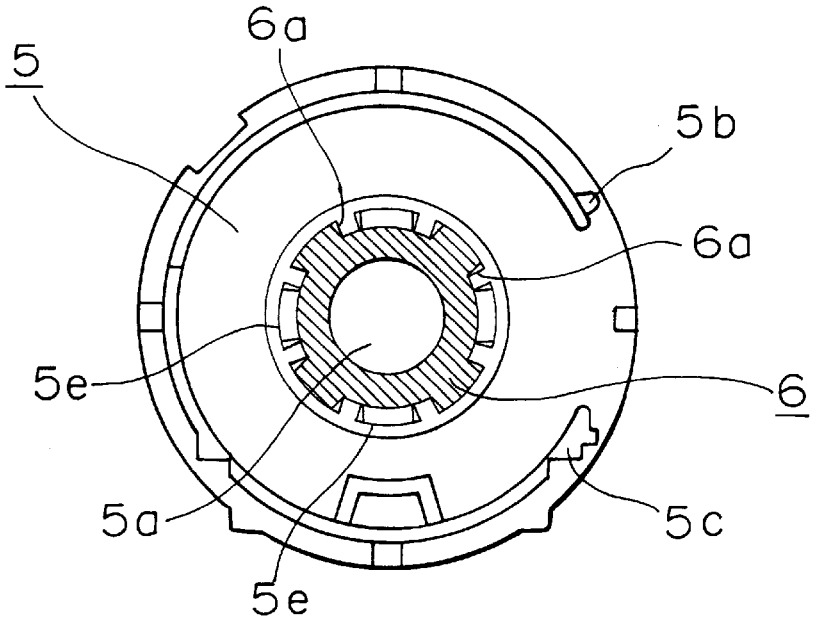
FIG. 10 is a bottom view of the holder shown in FIG. 9.
Figure 11:
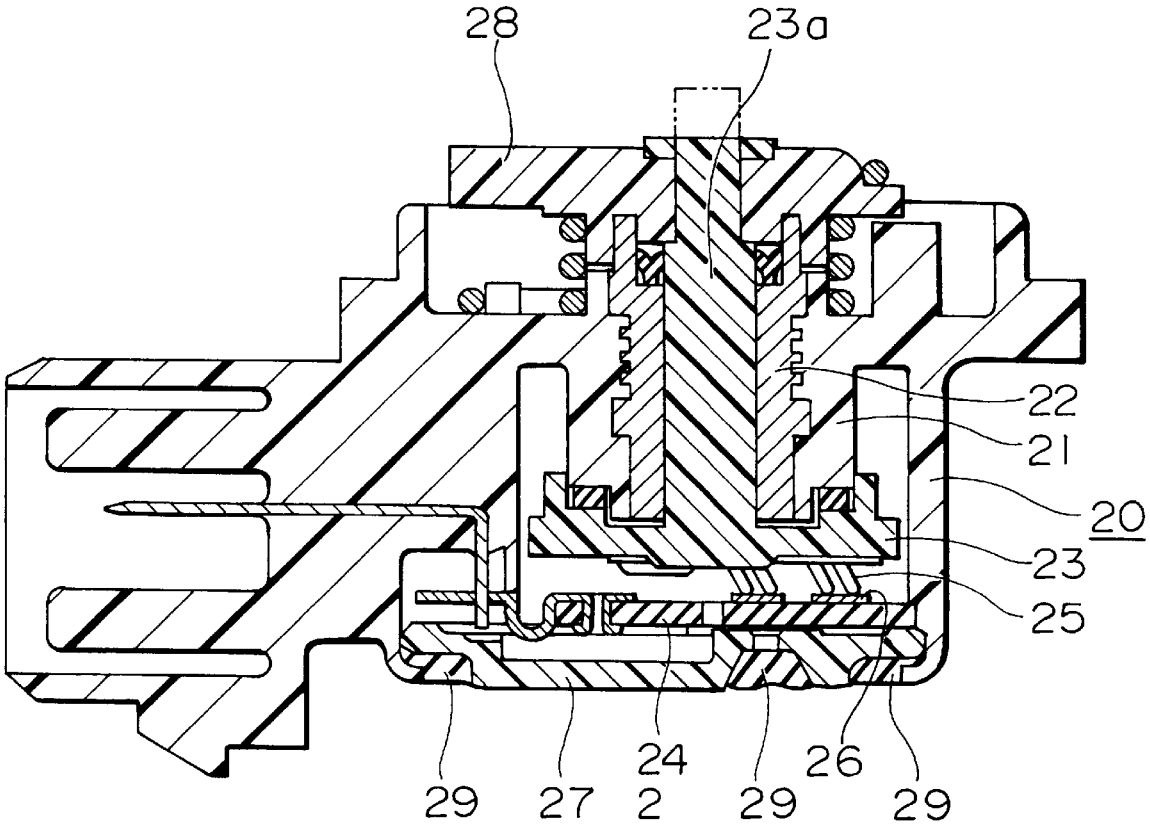
FIG. 11 PRIOR ART
FIG. 11 is a cross-sectional view of a conventional rotary operation type variable resistor.

Further, the holder 5 may alternatively be formed into a shape such as that shown in FIGS. 9 and 10. FIG. 9 is a plan view of the holder and FIG. 10 is a bottom view of the holder. In FIGS. 9 and 10, the same portions as those shown in FIGS. 4 and 5 are indicated by the same reference characters. Details of this holder configuration are as described below. Cuts 6*a* and 7*a* are formed in the bearings 6 and 7, and the bearings 6 and 7 are set in such positions as to be shifted from each other to a predetermined extent along the circumferential direction. In this manner, the upper bearing 7, as well as the lower bearing 6, is integrally combined with the holder 5 by being inserted in the same by an insert molding technique. That is, in this case, the flange of each of the pair of bearings 6 and 7 disposed at the opposite opening ends of the shaft hole 5*a* of the holder 5 is formed so as to provide the desired space for inserting the pins for pressing the flange of the other bearing at the time of insert molding. Accordingly, in the holder 5 after molding, holes 5*d* are formed in the cuts 7*a* of the flange of the upper bearing 7 by the insertion of the pressing pins for pressing the lower bearing 6 so as to retain the same in the mold during the insert molding, as shown in FIG. 9, while holes 5*e* are formed in the cuts 6*a* of the flange of the lower bearing 6 by the insertion of the pressing pins for pressing the upper bearing 7 so as to retain the same in the mold during the insert molding, as shown in FIG. 10.

The arrangement may alternatively be such that, after molding the holder 5, the cylindrical upright portions of the lower bearing 6 and the upper bearing 7 are respectively press-fitted into the opposite opening ends of the shaft hole 5*a* to integrally combine the two bearings 6 and 7 with the holder 5.

According to the present invention, as described above, a holder which axially supports a resistor base and a sliding-element supporting member is fixed in a case having a closed bottom by being inserted into the case through one opening opposite from the bottom and, thereafter, an operating lever may be fitted around a shaft portion of the sliding-element supporting member projecting from the holder and then fixed by a retaining means. Thus, the components parts can be assembled in the case by being placed one on another through one open side of the case. When the rotary operation type variable resistor is attached to a frame of a motor vehicle, the external bottom surface of the case faces outward opposite from the frame. Therefore, there is no need for sealing using a lid and any other separate member such as those required by the conventional art. Because of these effects, it is possible to provide an improved rotary operation type variable resistor in which component parts can be assembled easily.

Also, the arrangement is such that, when a pressing force for attaching the operating lever is applied to the sliding-element supporting member after the holder in the state of being mounted in the case before the operating lever is attached has been fixed in the case without interference through the operating lever, the receiving portion of the sliding-element supporting member is brought into abutment against the resistor base or the case to prevent plastic deformation of the sliding element. Therefore, even if the variable resistor is designed so as to be smaller, the holder can easily be mounted in the case without interference through the operating lever while the desired reliability can be maintained by the effect of preventing plastic deformation of the sliding element. Thus, it is possible to provide a rotary operation type variable resistor which can be suitably designed so as to be smaller in size.

According to the present invention, when the case is attached to a frame of a motor vehicle, the external bottom surface of the case faces outward opposite from the frame. Therefore, there is no need for sealing using a lid and any other separate member such as those required by the conventional art. The resilient part provided on the case is used to resiliently urge the holder toward the positioning portions of the case to achieve an increase in the accuracy with which the holder is mounted in the case, so that the variable resistor attachment portion provided on the case and the operating lever axially supported on the holder can be relatively positioned more easily. Also, the desired positioning accuracy of the operating lever when the body of the variable resistor is attached to the frame of the motor vehicle can be achieved more easily, and it is possible to improve the accuracy of attachment to an actuator on the motor vehicle. The resistor base may also be urged by the resilient part in the case so that the positioning reference portions of the resistor base abut against the positioning portions of the case, thereby ensuring that a misalignment cannot occur easily between the resistor base and the holder, and that the accuracy of the attached portion of the sliding element and the resistor case can be increased, thereby making it possible to provide a rotary operation type variable resistor having a resistance changing characteristic improved in linearity. Further, the resistor pattern may also be formed by printing based on the positioning reference portions of the resistor base to reduce a misalignment between the resistor base and the resistor pattern. Accordingly, the resistor base, the resistor pattern and the holder have one structural basis. Therefore, if only size control of each component is performed, there is no need to perform size control of combinations of the components, thus facilitating size control at the manufacturing stage.

Because the case having the attachment portion and the holder on which the resistor base and the siding-element supporting member are fixed are provided separately from each other, the case can easily be adapted to varieties of the attachment portion. If a unit formed by the holder and the other components on the holder is assembled in the case, changes of jigs can be reduced to simplify the assembly process. Also, such a unit can be adapted as a common part to cases having various shapes, so that the design freedom is increased and it is possible to maintain high reliability and to reduce the manufacturing cost by combining main components of the rotary operation type variable resistor into a common unit. Since the holder is resiliently urged by the resilient part of the case to bring the positioning reference portions of the holder into abutment against the positioning portions of the case, a misalignment cannot occur easily between the case and the holder, thus making it possible to provide a rotary operation type variable resistor having improved reliability.

Further, in the rotary operation type variable resistor in accordance with the present invention, a pair of metal bearings each formed by pressing so as to have a cylindrical portion and a flange portion formed at one end of the cylindrical portion are provided at opposite opening ends of the shaft hole of the holder, thus forming a bearing structure for axially supporting the sliding-element supporting member. The above-mentioned cylindrical portion has an inner circumferential surface with reduced surface irregularities and does not need machining. Therefore, this bearing structure can easily be formed, so that the manufacturing cost can be reduced. If a stainless steel plate, for example, is used as the material of the metal bearings, the bearings an have a sufficiently high mechanical strength and improved reliability because work hardening occurs therein at the time of pressing.

What is claimed is:

1. A rotary operation type variable resistor comprising:

a case having only one opening for component insertion, the case also having an attachment portion and a closed bottom;

a resistor base provided on the closed bottom of said case and having a surface upon which a resistor pattern is formed;

a holder fixedly retained in said case, said holder being formed with a shaft opening;

a sliding-element supporting member rotatably supported by said holder, the sliding-element supporting member having a sliding element supported thereon, said sliding element being maintained in sliding contact with said resistor pattern, the sliding-element supporting member including a shaft having a stepped portion, said shaft projecting toward the opening of said case and extending through the shaft opening of said holder, the sliding-element supporting member also including a receiving portion projecting toward the resistor base;

an operating lever fixedly connected to an outer end portion of said sliding-element supporting member such that movement of the operating lever causes a change in the rotational position of said sliding-element supporting member; and retaining means for retaining said operating lever in such a manner that said operating lever is pinched between said retaining means and the stepped portion of said shaft, and a resilient member interposed between said operating lever and said holder, wherein said receiving portion projecting from said sliding-element supporting member abuts against one of said resistor base and said case when said sliding element is pushed to move to a predetermined extent toward said resistor base, and wherein said resilient member biases said receiving portion away from the resistor base.

2. A rotary operation type variable resistor according to claim 1, wherein said receiving portion of said sliding-element supporting member is formed at the center of rotation of said sliding-element supporting member.

3. A rotary operation type variable resistor according to claim 2, wherein said resilient member comprises a wave washer.

4. A rotary operation type variable resistor according to claim 3, wherein said resilient member comprises a wave washer.

5. A rotary operation type variable resistor comprising:

a case having only one opening for component insertion, the case also having an attachment portion and a closed bottom;

a resistor base provided on the closed bottom of said case and having a surface upon which a resistor pattern is formed;

a holder fixedly retained in said case, said holder being formed with a shaft opening;

a sliding-element supporting member rotatably supported by said holder, the sliding-element supporting member having a sliding element supported thereon, said sliding element being maintained in sliding contact with said resistor pattern;

an operating lever fixedly connected to an outer end portion of said sliding-element supporting member such that movement of the operating lever causes a change in the rotational position of said sliding-element supporting member;

wherein said holder is formed with a first and second positioning reference portions, said first and said second positioning reference portions formed from a first projection and a second projection arranged at an outer circumferential surface of said holder and projecting outwardly therefrom;

wherein said case is formed with a first positioning portion forming a first positioning reference plane and a second positioning portion forming a second positioning reference plane, the positioning reference portions of said holder abutting against the first positioning portion and the second positioning portion of said holder case, said first and second positioning reference planes are formed from first and second vertical planes perpendicular to a bottom surface of the casing and formed by the first and second positioning reference planes crossed at a plane in parallel with a bottom surface of said case and not it parallel with each other; and a first resilient element formed within said case to resiliently urge said holder so that the positioning reference portions of said holder abut against the first positioning portion and second positioning portion of said case, the first resilient element formed within the case opposite to a side where the first and second positioning reference planes of said casing are crossed to each other and resiliently pressing the casing against a crossing side such that the first and second reference portions of the holder may be abutted against the first and second reference planes of the casing.

6. A rotary operation type variable resistor according to claim 5, wherein said resistor base includes second positioning reference portions abutting against said first and second positioning portions of said case, and wherein said case includes a second resilient element for resiliently urging said resistor base so that the positioning reference portions of said resistor base abut against said first and second positioning portions of said case.

7. A rotary operation type variable resistor according to claim 6, wherein said resistor pattern is formed in a predetermined positional relationship relative to the positioning reference portions of said resistor base.

8. A rotary operation type variable resistor according to claim 5, wherein said resistor base is fixedly connected to said holder.

9. A rotary operation type variable resistor according to claim 5, wherein said first and second positioning portions are formed by two sides of said case being perpendicular to each other, an outer shape of the casing is formed by a bottom wall and side walls and then said first and said reference planes formed at an inner wall of each of the side walls.

10. A rotary operation type variable resistor comprising:

a case having only one opening for component insertion and having an attachment portion and a closed bottom;

a holder having a shaft hole, said holder being retained in said case;

first and second metal bearing members each formed by pressing a plate into a shape having a hollow cylindrical portion and a flange portion located at one end of the cylindrical portion, said first and second metal bearing members being disposed at opposite opening ends of the shaft hole of said holder, wherein the flange portions of said first and second metal bearing members are positioned external to said shaft hole;

a resistor base provided between the closed bottom of said case and the holder, the resistor base having a resistor pattern formed on its surface; and a sliding-element supporting member having a sliding element supported thereon, said sliding element being maintained in sliding contact with said resistor pattern, said sliding-element supporting member being axially rotatably supported by said bearing members and wherein said sliding-element supporting member is arranged against said flange portion of said first metal bearing member.

11. A rotary operation type variable resistor according to claim 10, wherein said cylindrical portion of said second metal bearing member is press-fitted into said shaft hole.

12. A rotary operation type variable resistor according to claim 10, wherein said flanges of said first and second metal bearing members are provided with staggered recesses and said first and second metal bearing members are integrally fixed to said holder.

* * * * *

UNITED STATES PATENT AND TRADEMARK OFFICE

CERTIFICATE OF CORRECTION

PATENT NO. : 6,005,473
DATED : December 21, 1999
INVENTOR(S) : Kanji Ishihara

It is certified that error appears in the above-identified patent and that said Letters Patent is hereby corrected as shown below:

Claim 3,
Line 2, change "claim 2" to -- claim 1 --.

Claim 5,
Line 20, change "with a" to -- with --.
Line 31, change "not it parallel" to -- not parallel --.

Signed and Sealed this

Twenty-ninth Day of January, 2002

*Attest:*

*Attesting Officer*

JAMES E. ROGAN
*Director of the United States Patent and Trademark Office*